US007770517B2

(12) United States Patent
Ohsawa

(10) Patent No.: US 7,770,517 B2
(45) Date of Patent: Aug. 10, 2010

(54) PRINTING PRESS

(75) Inventor: Shin Ohsawa, Tsukuba (JP)

(73) Assignee: Komori Corporation, Tokyo (JP)

( * ) Notice: Subject to any disclaimer, the term of this patent is extended or adjusted under 35 U.S.C. 154(b) by 118 days.

(21) Appl. No.: 11/411,905

(22) Filed: Apr. 27, 2006

(65) Prior Publication Data

US 2006/0260485 A1 Nov. 23, 2006

(30) Foreign Application Priority Data

Apr. 28, 2005 (JP) ..... 2005-132223

(51) Int. Cl.
*B41F 21/00* (2006.01)
*B65H 5/04* (2006.01)
*B65H 5/02* (2006.01)

(52) U.S. Cl. ..... 101/246; 277/271

(58) Field of Classification Search ..... 101/174, 101/216, 226, 229, 231, 246
See application file for complete search history.

(56) References Cited

U.S. PATENT DOCUMENTS 3,384,011 A * 5/1968 Bolza-Schunemann ..... 101/177
3,557,692 A * 1/1971 Lee ..... 101/177
4,839,814 A * 6/1989 Steidel ..... 700/122
5,117,753 A * 6/1992 Mamberer ..... 101/225
5,579,691 A * 12/1996 Voge ..... 101/246
5,590,598 A * 1/1997 Keller ..... 101/479
5,797,319 A * 8/1998 Tomczak ..... 101/216
5,918,542 A * 7/1999 Ruprecht ..... 101/226
6,095,043 A * 8/2000 Hartmann et al. ..... 101/183
6,546,863 B2 * 4/2003 Schaum et al. ..... 101/248
6,776,750 B2 * 8/2004 Stieler et al. ..... 493/424
6,810,806 B2 * 11/2004 Faulhammer et al. ..... 101/410
6,823,792 B2 * 11/2004 Grutzmacher et al. ..... 101/483
6,899,327 B2 * 5/2005 Shimizu et al. ..... 271/276

FOREIGN PATENT DOCUMENTS

JP 1-285338 A 11/1989

* cited by examiner

*Primary Examiner*—Judy Nguyen
*Assistant Examiner*—Leo T Hinze
(74) *Attorney, Agent, or Firm*—Birch, Stewart, Kolasch & Birch, LLP

(57) ABSTRACT

A printing press includes: a printing unit which performs offset printing on a sheet; a machining unit including a rotary die which performs a punching process for the sheet subjected to the printing by the printing unit; a first motor which drives an impression cylinder and the like of the printing unit; a second motor which drives the rotary die and the like of the machining unit; and a control device which controls the drives of the first motor and the second motor to be synchronized with each other.

12 Claims, 8 Drawing Sheets

PRINTING PRESS

BACKGROUND OF THE INVENTION

1. Field of the Invention

The present invention relates to a printing press including a printing unit and a machining unit which machines a sheet subjected to printing by the printing unit.

2. Description of the Related Art

A container made of a sheet such as paper or the like, for packaging or housing a commodity product or the like therein, is usually manufactured in such a manner that a pattern of the container in a developed state is printed on the sheet by a printing press, a developed portion of the sheet is then punched, and a sheet piece obtained by the punching is assembled. An apparatus has been proposed, in which such processes of printing the pattern on the sheet and punching the developed portion into a predetermined shape (a developed shape of the container) are performed in a series of processes. For example, Japanese Patent Laid-Open Publication No. H1-285338 (published in 1989) discloses a sheet-fed offset/paper container machining apparatus in which a sheet-fed offset press and a puncher are arranged in a series.

Such a printing/machining apparatus (hereinafter, also referred to as a "machining apparatus") disclosed in Japanese Patent Laid-Open Publication No. H1-285338 also includes a single drive source as in a general printing press. Specifically, the printing press and the puncher are driven by the single drive source. By the single drive source, the respective cylinders and the like of the printing press are driven through a gear mechanism, and a die and the like of the puncher are driven through a gear mechanism.

Incidentally, in the processing apparatus described above, since large power is required for a punching process by the puncher, load variations at the time of the punching are large, and the load variations are transmitted to other portions of the machine through the gears. There is a possibility that phase deviations can occur on printing products in the puncher and a printing unit owing to the transmission of the load variations. Moreover, a phenomenon that the gears rotate reversely (or stop) occurs owing to the load variations, and when the phenomenon reaches the printing unit, a state where the cylinders do not move occurs for a moment during the printing. Thus, a stripe (a shock streak) is formed in the printing portion, causing a printing failure.

It is an object of the present invention, in the printing press including the printing unit and the machining unit in series, to eliminate a phase change between the printing unit and the machining unit, and to eliminate the printing failure.

SUMMARY OF THE INVENTION

An aspect of the present invention is a printing press, comprising:

a printing unit which performs printing on a sheet;

a machining unit which performs a machining process for the sheet;

first driving means for driving the printing unit;

second driving means for driving the machining unit; and controlling means for controlling the first and second driving means to synchronize the drives of the printing unit and the machining unit with each other.

In accordance with the printing press according to the present invention, the printing unit and the machining unit which perform a series of work are driven by separate driving means (the first driving means and the second driving means). Accordingly, the load by the machining in the machining unit is avoided from being transmitted to the printing unit, and the printing failure such as the phase deviations of the sheets (the printing products) between the machining unit and the printing unit and the formation of the shock streak in the printing unit is eliminated. Since the control device which controls the drives of the first and second driving means to be synchronized with each other is provided, the phase deviations between the machining unit and the printing unit do not occur.

For example, the printing press according to the present invention may further comprise:

a plurality of first sheet holding means for transporting the sheet, the first sheet holding means being provided in the printing unit in a direction perpendicular to a transporting direction of the sheet; and a plurality of second sheet holding means for transporting the sheet transferred from the first sheet holding means, the second sheet holding means being provided in the machining unit while deviating phases thereof from phases of the first sheet holding means in the direction perpendicular to the transporting direction of the sheet.

In accordance with the printing press according to this example, the first sheet holding means and the second sheet holding means which retain the sheet such as paper for transporting and transferring the sheet are provided while deviating the phases thereof from each other in the direction perpendicular to the transporting direction of the sheet (which is an axial direction of cylinders). Accordingly, the first sheet holding means and the second sheet holding means do not interfere with each other. For example, even if a time required to stop the printing unit and a time required to stop the machining unit differ from each other owing to a difference therebetween in inertia at the time when the printing press is stopped (when the first driving means and the second driving means are stopped), the first sheet holding means and the second sheet holding means do not interfere with each other.

For example, the printing press according to the present invention may further comprise:

a first cylinder which supports the first sheet holding means; and a second cylinder which supports the second sheet holding means, wherein a plurality of first notched portions may be provided on a circumferential surface of the first cylinder, to which the second sheet holding means oppose, the circumferential surface supporting the sheet, and a plurality of second notched portions may be provided on a circumferential surface of the second cylinder, to which the first sheet holding means are opposite, the circumferential surface supporting the sheet.

In accordance with the printing press according to this example, in the case where the first and second sheet holding means are provided on the cylinders, the first and second sheet holding means do not interfere with the cylinders of the other parties in a portion which connects the printing unit and the machining unit to each other since the notches are provided on the circumferential surfaces of the cylinders, to which the first and second sheet holding means correspond.

For example, the printing press according to the present invention may further comprise: sheet releasing means for releasing retention of the sheet by the first sheet holding means on an upstream side, in the transporting direction of the sheet, of a position where the sheet is transferred between the first sheet holding means and the second sheet holding means.

In accordance with the printing press according to this example, even in the case where the sheet is not transferred from the printing unit to the machining unit, the printing unit can discharge the sheet by itself. Hence, in the case where the operation of the printing press is resumed after being once stopped, the sheet in the printing unit is discharged by the sheet releasing means before the operation is resumed, thus making it possible to prevent paper jamming in a boundary between the printing unit and the machining unit. Specifically, since the printing unit and the machining unit are driven by the driving means of their own, such a malfunction is prevented that the sheet jams without being transferred from the printing unit to the machining unit in the case where the speeds of the first sheet holding means and the second sheet holding means do not coincide with each other immediately after the operation is resumed.

In accordance with the printing press according to this example, such a new problem can also be solved that the jamming of the sheet, which may be caused by separating the drive source, occurs in the case where rotation phases are deviated between the printing unit and the machining unit when the operation is resumed.

For example, the printing press according to the present invention may further comprise:

sheet dropping means for dropping the sheet of which retention is released by the sheet releasing means, the sheet dropping means entering at least one of the first notched portions; and sheet collecting means for receiving the sheet dropped by the sheet dropping means.

In accordance with the printing press according to this example, the sheet dropping means is provided, the sheet of which retention is released from the first sheet holding means is positively chopped. Accordingly, the sheet can be surely eliminated from the printing unit.

For example, the printing press according to the present invention may further comprise:

a first cylinder which supports the first sheet holding means; and a second cylinder which supports the second sheet holding means, wherein the first cylinder may be a skeleton cylinder which does not have a cylindrical cylinder portion, and the second cylinder is a skeleton cylinder which does not have a cylindrical cylinder portion.

For example, the printing press according to the present invention may further comprise: a chain which is driven and circulated, thereby transporting the sheet, wherein the chain supports at least one of the first sheet holding means and the second sheet holding means.

For example, in the printing press according to the present invention, the controlling means may control one of the first and second driving means while taking a speed of the other one of the first and second driving means as a reference.

For example, in the printing press according to the present invention, the machining unit may perform the machining process for the sheet subjected to the printing by the printing unit.

For example, in the printing press according to the present invention, the controlling means may control the first and second driving means based on a reference rotation speed set in virtual speed setting means.

For example, the printing press according to the present invention may further comprise: a switch to be operated after a sudden stop of the printing press, wherein the first driving means, the second driving means, and the sheet releasing means may be operated by the operation of the switch through the controlling means.

For example, in the printing press according to the present invention, the sheet releasing means may be controlled to automatically return to a position thereof before the operation of the switch at predetermined timing after the sheet is discharged into the printing unit.

For example, in the printing press according to the present invention, the predetermined timing may be determined by a timer which counts a predetermined time.

For example, in the printing press according to the present invention, the machining unit may be a puncher.

For example, in the printing press according to the present invention, the printing unit may be an offset press.

BRIEF DESCRIPTION OF THE DRAWINGS

The present invention will become more fully understood from the detailed description given hereinbelow and the accompanying drawings which are given by way of illustrations only, and thus are not limitative of the present invention and wherein.

DETAILED DESCRIPTION OF THE INVENTION

A description will be made below in detail of a printing press according to the present invention by embodiments by using the drawings.

Embodiment 1

In this embodiment, a sheet-fed offset press is employed as a printing unit, and a rotary die (a rotary puncher) is employed as a machining unit.

Figure 1:
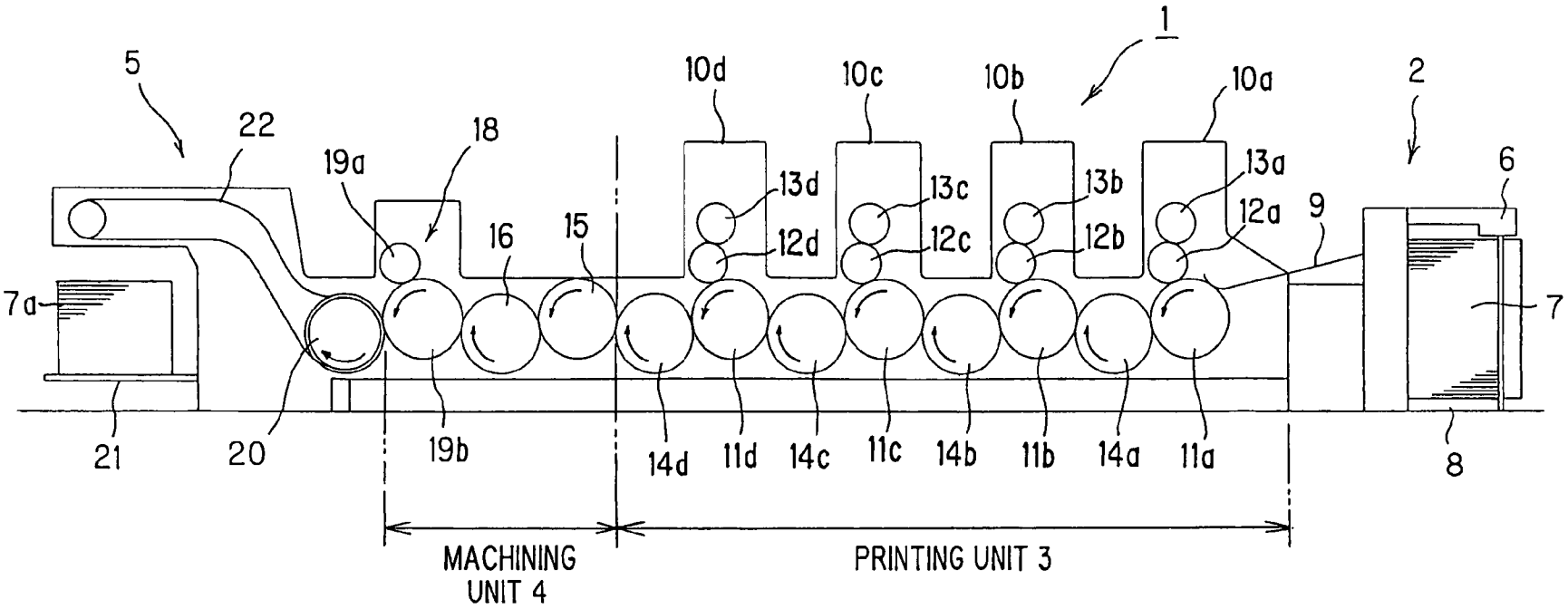
FIG. 1 shows a schematic side view of a printing press according to Embodiment 1 of the present invention.

As shown in FIG. 1, a printing press 1 is composed of a feeder 2 which feeds sheets, a printing unit 3 which performs offset printing on the sheets, a machining unit 4 which performs a punching process for the printed sheets (printing products), and a delivery unit 5 which transports and discharges the processed sheets.

The feeder 2 includes a sheet feeder 6, and the sheet feeder 6 includes a pile board 8 which stacks sheets 7 thereon, and a sheet feeding apparatus (not shown) provided above the pile board 8. The uppermost sheet 7 of the sheets 7 stacked on the pile board 8 is sucked by the feeding apparatus, and is fed forward. A table 9 is connected to a sheet 7 feeding side of the sheet feeder 6, and the sheets 7 are transported on the table 9. Note that the pile board 8 is automatically elevated in order to maintain a height of the uppermost sheet 7 of the sheets 7 stacked thereon at a constant level.

The printing unit 3 follows the feeder 2. The printing unit 3 in this embodiment is one which prints four colors on the sheets 7, and the printing unit 3 includes four (first to fourth) printing units 10*a*, 10*b*, 10*c* and 10*d*.

On an end side of the table 9 of the feeder 2, an impression cylinder 11*a* including a gripper (not shown) which grasps the sheets 7 fed onto the table 9 is provided. Above the impression cylinder 11*a*, a blanket cylinder 12*a* around which a blanket (not shown) performing printing on the sheets 7 is wound is provided. Above the blanket cylinder 12*a*, a plate cylinder 13*a* onto which a plate (not shown) transferring ink to the blanket is attached is provided. Above the plate cylinder 13*a*, there are provided an inking device (not shown) which supplies ink to the plate, and a dampening unit (not shown) which supplies dampening water to the plate. On a downstream side of the impression cylinder 11*a* in the transporting direction of the sheets 7, a transfer cylinder 14*a* which includes a gripper (not shown) receiving the sheets 7 retained on the impression cylinder 11*a* is provided.

Specifically, the sheets 7 retained on the impression cylinder 11*a* are transferred to the transfer cylinder 14*a* after the printing is performed thereon by the blanket of the blanket cylinder 12*a* to which an image portion of the plate of the plate cylinder 13*a* is transferred.

The first printing unit 10*a* is composed of the impression cylinder 11*a*, the blanket cylinder 12*a*, the plate cylinder 13*a*, the inking device, the dampening unit, the transfer cylinder 14*a*, and the like.

On a downstream side of the first printing unit 10*a* in the transporting direction of the sheets 7, there is provided the second printing unit 10*b* which includes an impression cylinder 11*b*, a blanket cylinder 12*b*, a plate cylinder 13*b*, an inking device, a dampening unit, a transfer cylinder 14*b*, and the like as in the first printing unit 10*a*. Specifically, the sheets 7 from the transfer cylinder 14*a* of the first printing unit 10*a* are transferred to the impression cylinder 11*b* of the second printing unit 10*b*, are subjected to the printing as in the first printing unit 10*a*, and are transferred to the transfer cylinder 14*b*.

Moreover, in a similar way to the above, there are provided the third printing unit 10*c* which includes an impression cylinder 11*c*, a blanket cylinder 12*c*, a plate cylinder 13*c*, an inking device, a dampening unit, a transfer cylinder 14*c*, and the like, and the fourth printing unit 10*d* which includes an impression cylinder 11*d*, a blanket cylinder 12*d*, a plate cylinder 13*d*, an inking device, a dampening unit, a transfer cylinder 14*d* as a first cylinder, and the like. By using various types for the plates and ink colors of the respective printing units 10*a* to 10*d*, color printing products having a plurality of colors can be obtained.

The machining unit 4 is provided following the printing unit 3. At an end portion of the machining unit 4, a transport cylinder (transfer cylinder) 15 as a second cylinder, to which the sheets 7 are transferred from the transfer cylinder 14*d* of the fourth printing unit 10*d*, is provided. A transport cylinder (transfer cylinder) 16 is provided following the transport cylinder 15 continuously thereto. As a machining apparatus, a rotary die 18 is provided following the transport cylinder 16. The rotary die 18 is composed of an upper cylinder 19*a* having a convex die portion, and a lower cylinder 19*b* having a concave die portion corresponding to the convex die portion. The sheets 7 enter between the upper and lower cylinders 19*a* and 19*b* described above, and thus are subjected to the punching process by the die portions. Shapes of the die portions are, for example, a developed shape of a container. Note that a portion (for example, a development of the container) punched by the rotary die 18 is discharged and collected. When the machining apparatus is a creaser which performs not the punching but a creasing process, the sheets 7 are directly transported as the machined sheets to the delivery unit 5 to be described later.

The delivery unit 5 is provided following the machining unit 4. The delivery unit 5 includes a delivery cylinder 20 which receives the machined sheets 7*a*, a pile board 21 which stacks the machined sheets 7*a* thereon, and a chain 22 which is bridged between a sprocket provided on the delivery cylinder 20 and a sprocket provided above the pile board 21 and includes a plurality of delivery grippers.

The printing and machining by the printing press 1 which includes a series the printing unit 3 and the machining unit 4 as described above are performed in the following manner.

Each of the sheets 7 is fed to the table 9 from the sheet feeding apparatus 6 in the feeder 2. In the printing unit 3, the sheet 7 is retained on the impression cylinder 11*a* of the first printing unit 10*a*, and is subjected to the offset printing by the blanket cylinder 12*a*. The sheet 7 subjected to the printing is transferred to the transfer cylinder 14*a*. Following this process, the sheet 7 is subjected to the printing through the second printing unit 10*b*, the third printing unit 10*c*, and the fourth printing unit 10*d* as in the first printing unit 10*a*.

The sheet 7 subjected to the printing is transferred to the transport cylinder 15 of the machining unit 4 from the transfer cylinder 14*d* of the fourth printing unit 10*d*. The sheet 7 enters the rotary die 18 from the transport cylinder 15 through the transport cylinder 16, and is subjected to the punching process by the upper and lower cylinders 19*a* and 19*b*. The punched portion is discharged and collected. The sheet 7*a*, formed by punching out a product portion of the sheet 7, is transferred to the delivery cylinder 20 of the delivery unit 5, is moved above the pile board 21 while being grasped by the grippers provided on the chain 22, and is stacked on the pile board 21 by being released from the grippers.

Figure 3:
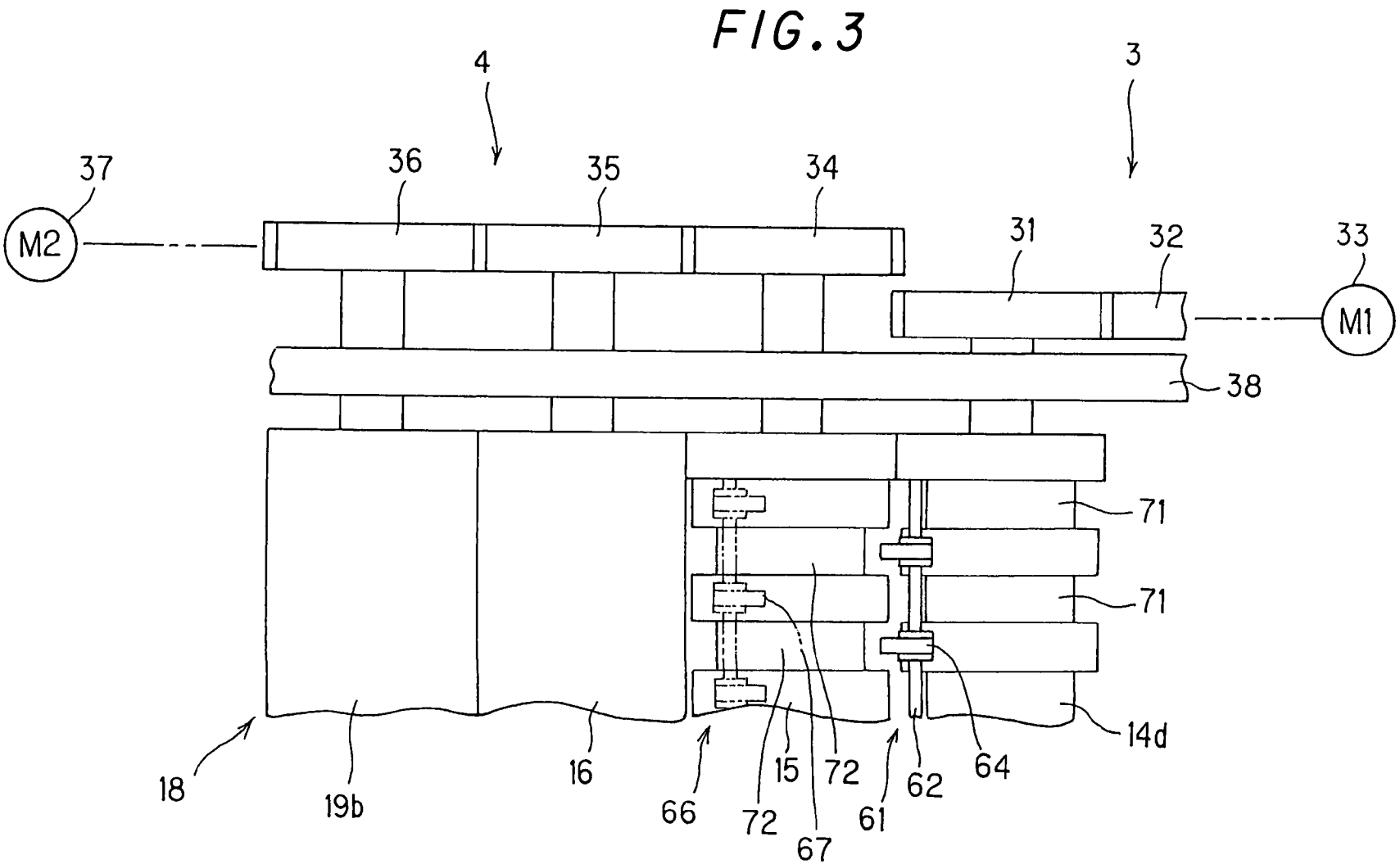
FIG. 3 shows a plan view of FIG. 2.

In the printing press 1 as described above, a drive system of the printing unit 3 and a drive system of the machining unit are separated from each other. Specifically, as shown in FIG. 3, gears (only two gears 31 and 32 are shown in the drawing) coupled to the respective cylinders of the printing units 10*a* to 10*d* of the printing unit 3 are driven by a first motor 33 as first driving means, and gears (only three gears 34, 35 and 36 are shown in the drawing) coupled to the cylinders 15 and 16 of the machining unit 4 and the rotary die 18 are driven by a second motor 37 as second driving means. The delivery cylinder 20 in the delivery unit 5 is also driven by the second motor 37. Note that the gear 31 is coupled to the transfer cylinder 14*d* of the fourth printing unit 10*d* supported between frames 38 (only one frame appears in the drawing) of the printing press 1, that the gear 34 is coupled to the transport cylinder 15 of the machining unit, that the gear 35 is coupled to the transport cylinder 16 thereof, and that the gear 36 is coupled to the lower cylinder 19*b* of the rotary die 18 thereof.

Figure 5:
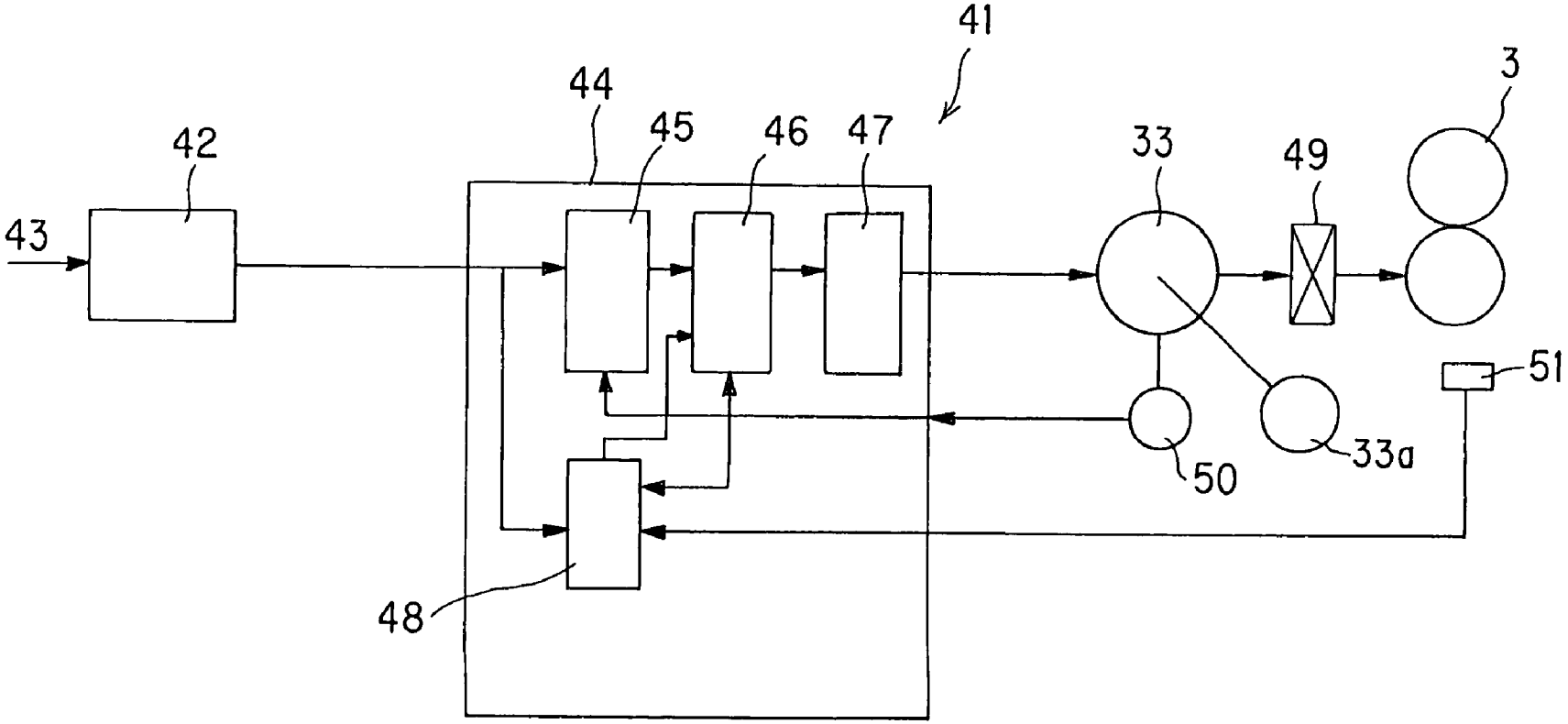
FIG. 5 shows a block diagram of a synchronization control device.

The first motor 33 and the second motor 37 must be driven in synchronization with each other, and a drive control for each of the motors is performed by a control device 41 shown in FIG. 5. A configuration of the control device 41 is the same between the first motor 33 and the second motor 37, and accordingly, a description will be made here of the configuration of the control device for the first motor 33.

Reference numeral 42 denotes a virtual pulse generator (PG) master setter as virtual speed setting means. To the virtual pulse generator master setter 42, a reference rotation speed of the target motor 33 is inputted as a speed instruction 43, and is set therein. The speed instruction is represented, for example, by a change of the speed with respect to a time (a time-speed curve). The virtual PG master setter 42 generates a pulse signal in response to the speed instruction, and outputs the generated pulse signal to a drive control unit 44.

The drive control unit 44 includes a synchronization position deviation counter 45, a speed control unit 46, an inverter torque control unit/drive unit 47, and an origin alignment control unit 48. The speed signal from the virtual PG master setter 42 passes through the synchronization position deviation counter 45, the speed control unit 46, and the inverter torque control unit/drive unit 47, and is inputted, for example, as a current signal to the first motor 33. Thus, the first motor 33 is driven. Drive force of the first motor 33 passes through a gear mechanism 49 including the gears 31 and 32 shown in FIG. 3, and is used for driving the respective printing units 10*a* to 10*d* of the printing unit 3. Note that reference numeral 33*a* denotes a mechanical brake provided in the first motor 33.

An actual rotation speed of the first motor 33 is detected by a pulse generator 50, and feedback of a result of the detection is made to the synchronization position deviation counter 45. When there is a deviation between an actual rotation and a value of the speed instruction, the deviation is calculated, and based on the calculated deviation, the speed of the first motor 33 is controlled so that the signal outputted through the inverter torque control unit/drive unit 47 can be corrected to be an instructed speed.

Note that an origin position is set on a predetermined cylinder in the printing unit 3 or the machining unit 4, and the position is detected by a position sensor 51, and an origin signal from the position sensor 51 is inputted to the origin alignment control unit 48. A signal for such origin alignment is outputted from the origin alignment control unit 48 to the speed control unit 46. For example, the origin position is provided on the transfer cylinder 14*d* in the printing unit 3, and is provided on the transport cylinder 15 in the machining unit 4.

A speed of the second motor 37 is also controlled by a speed control system similar to the above based on the same speed instruction, and the first motor 33 and the second motor 37 are synchronized with each other. Note that, with regard to a method of synchronizing the first motor 33 and the second motor 37 with each other, not only the control is made by giving the same speed instruction to the control systems of both of the motors as described above, but also the control may be made so as to synchronize the speed of the other motor with the speed of one motor, which is taken as a reference.

As described above, the drive systems of the printing unit 3 and the machining unit 4 are separated from each other, and thus, even if large-load machining is performed in the machining unit 4, an influence thereof is not given to the printing unit 3. As in this embodiment, even if the sheet 7 is subjected to the punching process by the rotary die 18 in the machining unit 4, and the gears in the machining unit 4 stop for a moment, the printing unit 3 is driven by the first motor 33 of its own, and accordingly, a phase is not deviated between the printing unit 3 and the machining unit 4, or a streak (a line) is not made in the printing portion.

Owing to the fact that the printing unit 3 and the machining unit 4 are separated from each other, it is anticipated that a speed difference will occur in a boundary portion between the printing unit 3 and the machining unit 4 owing to a difference therebetween in inertia when the printing press stops or starts (when the synchronization therebetween is adjusted), and further, when a power failure occurs suddenly in the printing state. Specifically, it is anticipated that the speed difference will occur between the transfer cylinder 14*d* of the fourth printing unit 10*d*, which is the final cylinder of the printing unit 3, and the transport cylinder 15 that is the top-end cylinder of the machining unit. The present invention employs means capable of dealing with such a circumstance. A description will be made below of the means.

Figure 2:
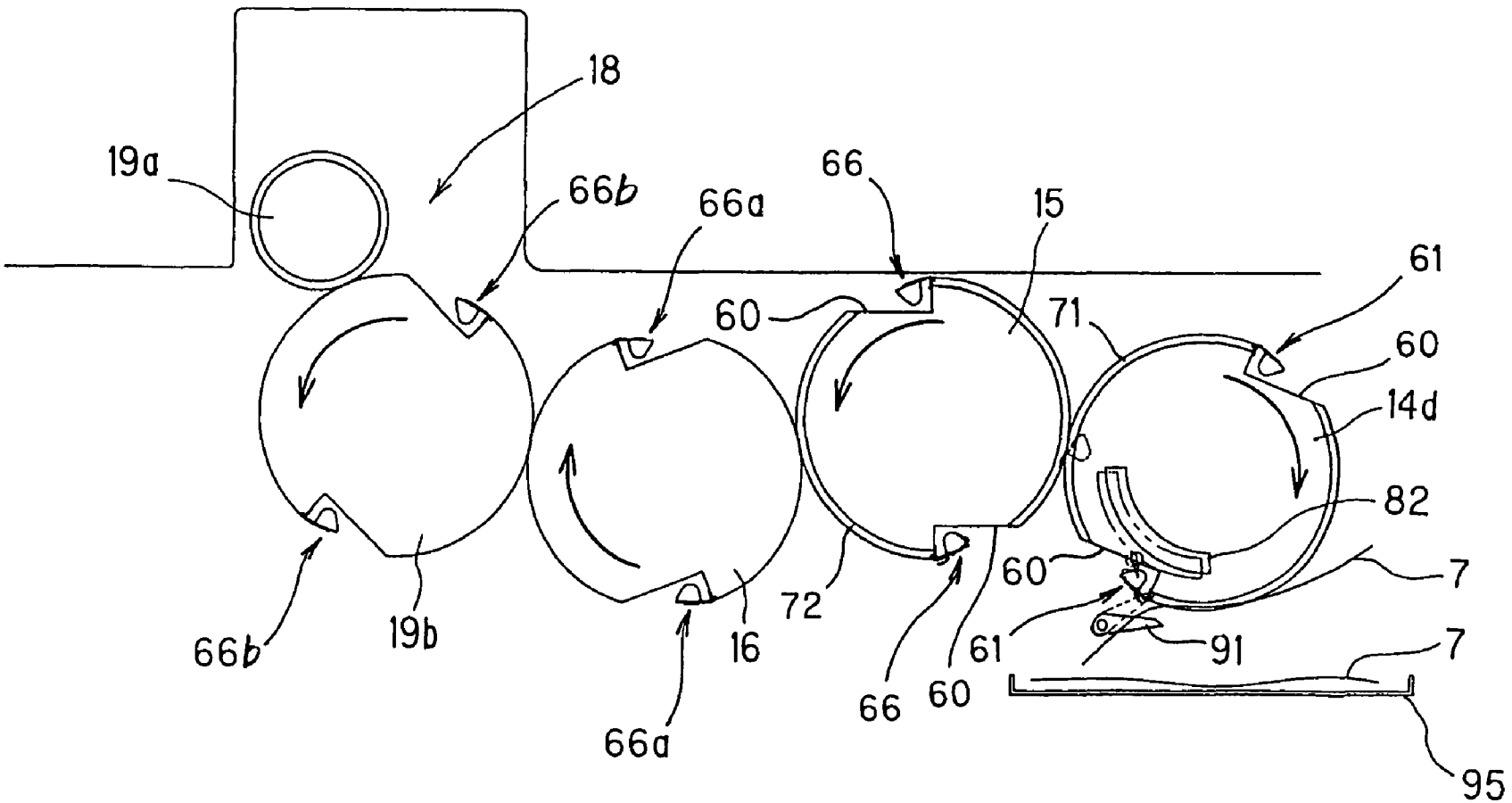
FIG. 2 shows a partially enlarged view of FIG. 1.
Figure 4:
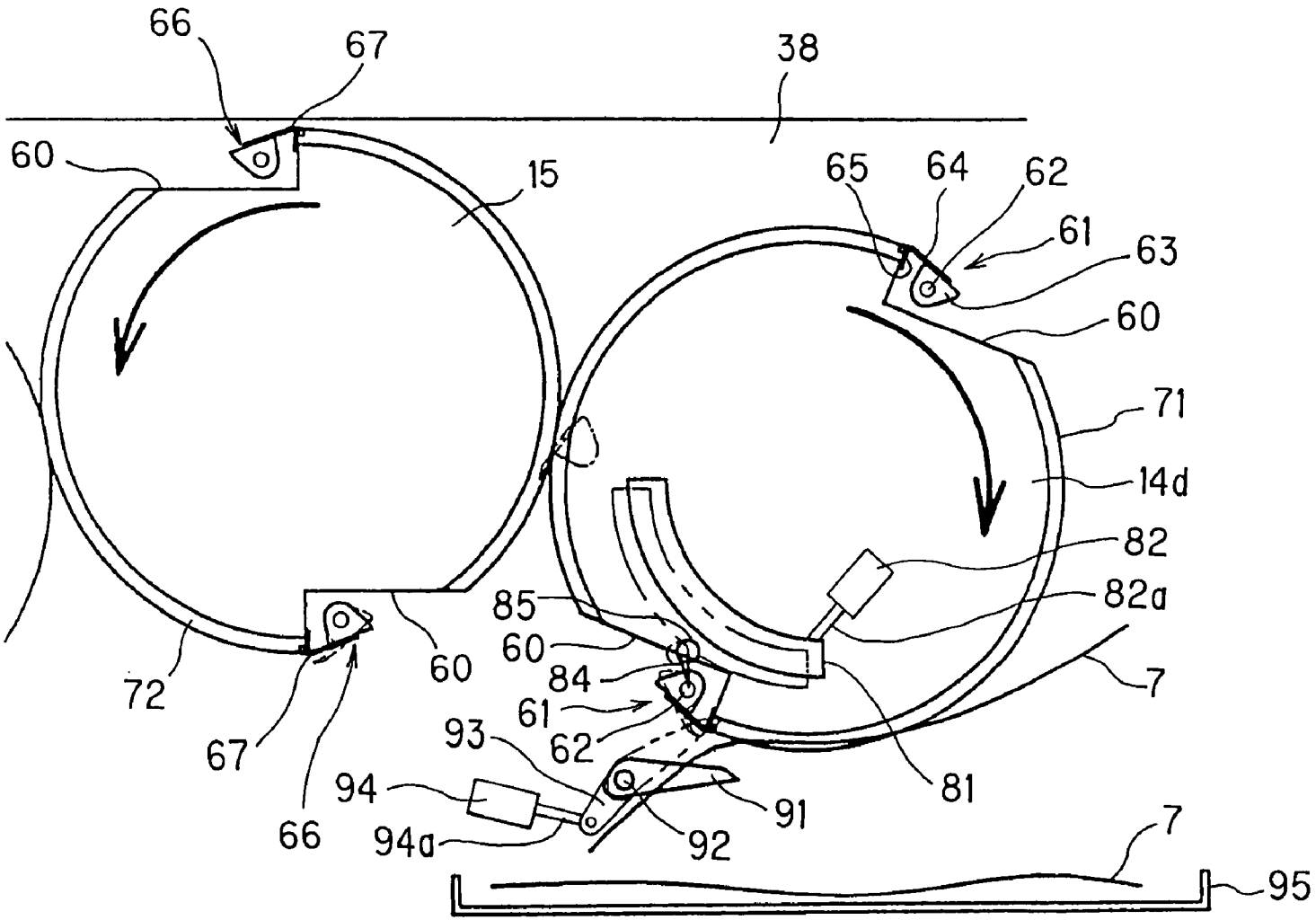
FIG. 4 shows an enlarged view of a transfer cylinder and a transport cylinder in FIG. 2.

As shown in FIGS. 2, 3 and 4, notched portions 60 are individually formed at positions opposite to each other on a circumferential surface of the transfer cylinder 14*d* that is the final cylinder of the printing unit 3, and in the respective notched portions 60, gripper mechanisms 61 are provided. Each of the gripper mechanisms 61 includes a plurality of grippers 64 retained by a holder 63 on a gripper shaft 62 parallel to an axial direction of the transfer cylinder 14*d* (which is a direction perpendicular to the transporting direction of the sheet 7). A gripper receiver 65 which sandwiches the sheet 7 between the grippers 64 and the gripper receiver 65 itself is provided in each of the notched portions 60 on the transfer cylinder 14*d*.

A lever (not shown) is attached to an end portion of the gripper shaft 62, and on an end portion of the lever, a wheel (not shown) is provided as a cam follower. Meanwhile, a cam (not shown) is fixed at a predetermined position on the frame 38 side of the printing press 1. Hence, when the transfer cylinder 14*d* rotates, and the grippers 64 come to positions where to release the sheet 7 retained thereby in order to transfer the sheet 7 concerned to the transport cylinder 15, the wheel on the gripper side abuts on the fixed cam to rotate the gripper shaft 62, thereby opening the grippers 64. At other positions than the above, the grippers 64 are made to abut on the gripper receiver 65 by engagement of the wheel and the cam or by spring force.

In a similar way to the above, notched portions 60 are formed also on the transport cylinder 15, and gripper mechanisms 66 with a similar configuration to the above are provided thereon. The gripper mechanisms 66 are provided while deviating phases thereof from those of the grippers 64 of the transfer cylinder 14*d* in the direction perpendicular to the transporting direction of the sheet 7 (which is the axial direction of the cylinders). Note that the positions of the grippers 67 shown in FIG. 3 are shown for the illustrative purpose that the grippers 67 are deviated from the grippers 64 in the axial direction of the cylinders, and positions of the grippers 67 in the rotation direction of the transport cylinder 15 are not accurate. FIG. 2 shows that gripper mechanisms 66*a* and 66*b* for transferring the sheet, which are similar to the above, are also provided on the other transfer cylinder 16 and the lower cylinder 19*b* of the rotary die 18.

As shown in FIG. 3, notched portions 71 as first notched portions are formed at positions on the circumferential surface of the transfer cylinder 14*d*, which correspond to the grippers 67 of the transport cylinder 15. In a similar way to this, notched portions 72 are also formed at positions on a circumferential surface of the transport cylinder 15, which correspond to the grippers 64 of the transfer cylinder 14*d*. Since the notched portions 60 for providing the gripper mechanisms 61 and 66 are formed on the circumferential surfaces of the transfer cylinder 14*d* and the transport cylinder 15, notched portions are formed across the entire surfaces of the transfer cylinder 14*d* and the transport cylinder 15 by the notched portions 60 and the notched portions 71 and 72. Hence, even if rotation phases of the transfer cylinder 14*d* and the transport cylinder 15 are deviated from each other when the printing press starts or stops, when the power failure occurs, and so on, ends of the grippers 64 or 67 are fit into the notched portions 60, the notched portions 71, or the notched portions 72, and do not interfere with the circumferential surface of the other cylinder 15 or 14*d*.

Note that, since the notched portions 71 and 72 are ones for preventing such interference with the other grippers 64 and 67, any notched shape may be employed therefor as long as the notched portions 71 and 72 have a structure capable of avoiding the interference.

In the case where the operation of the printing press 1 is resumed after the sudden stop caused by the power failure and others, when the phases are different between the printing unit 3 and the machining unit 4, the printing product which has remained in the printing unit 3 is not transferred from the transfer cylinder 14*d* of the printing unit 3 to the transport cylinder 15 of the machining unit 4, and jams between the transfer cylinder 14*d* and the transport cylinder 15. Therefore, the printing product in the printing unit 3 can be made to be discharged when the operation of the printing press 1 is resumed after the sudden stop caused by the power failure and others.

As shown in FIG. 4, on the frame 38 on the side of the transfer cylinder 14*d*, a gripper-opening cam 81 is provided so as to be movable in the radius direction of the transfer cylinder 14*d* separately from the cam for opening the grippers 64 of the gripper mechanism 61. The gripper-opening cam 81 is provided on an upstream side (front side), in the transporting direction of the sheet, of a position where the sheet 7 is transferred to the transport cylinder 15. A rod 82*a* of a movable-cam air cylinder 82 as driving means is coupled to the gripper-opening cam 81, and by drive of the movable-cam air cylinder 82, the gripper-opening cam 81 is located at a standby position (shown by solid lines in the drawings) and a forward position (shown by two-dotted chain lines in the drawings). In this embodiment, the gripper-opening cam 81, the movable-cam air cylinder 82, and the like, which are described above, constitute sheet releasing means.

On an end portion of the gripper shaft 62, a lever 84 is provided integrally with the gripper shaft 62, and on an end portion of the lever 84, a wheel 85 as a cam follower capable of being engaged with the gripper-opening cam 81 is provided.

Moreover, below the transfer cylinder 14*d*, a plurality of guide blades 91 are arranged in the axial direction of the transfer cylinder 14*d*. The guide blades 91 are fixed at positions of a shaft 92 parallel to the axial direction of the transfer cylinder 14*d*, which correspond to the notched portions 71 of the transfer cylinder 14*d*. Onto an end portion of the shaft 92, a lever 93 is attached integrally therewith, and to the lever 93, a rod 94*a* a of a blade air cylinder 94 is coupled. By drive of the blade air cylinder 94, the guide blades 91 are made selectively locatable at a standby position (shown by solid lines in the drawings) apart from the circumferential surface of the transfer cylinder 14*d* and at a guide position (shown by two-dotted chain lines in the drawings) where ends of the guide blades 91 concerned enter the notched portions 71 of the transfer cylinder 14*d*. In this embodiment, the guide blades 91 and the blade air cylinder 94 constitute sheet dropping means in a fifth invention.

Below the transfer cylinder 14*d*, a receiving tray 95 (sheet collecting means) for collecting the sheet 7 released from the transfer cylinder 14*d* is provided.

Figure 6:
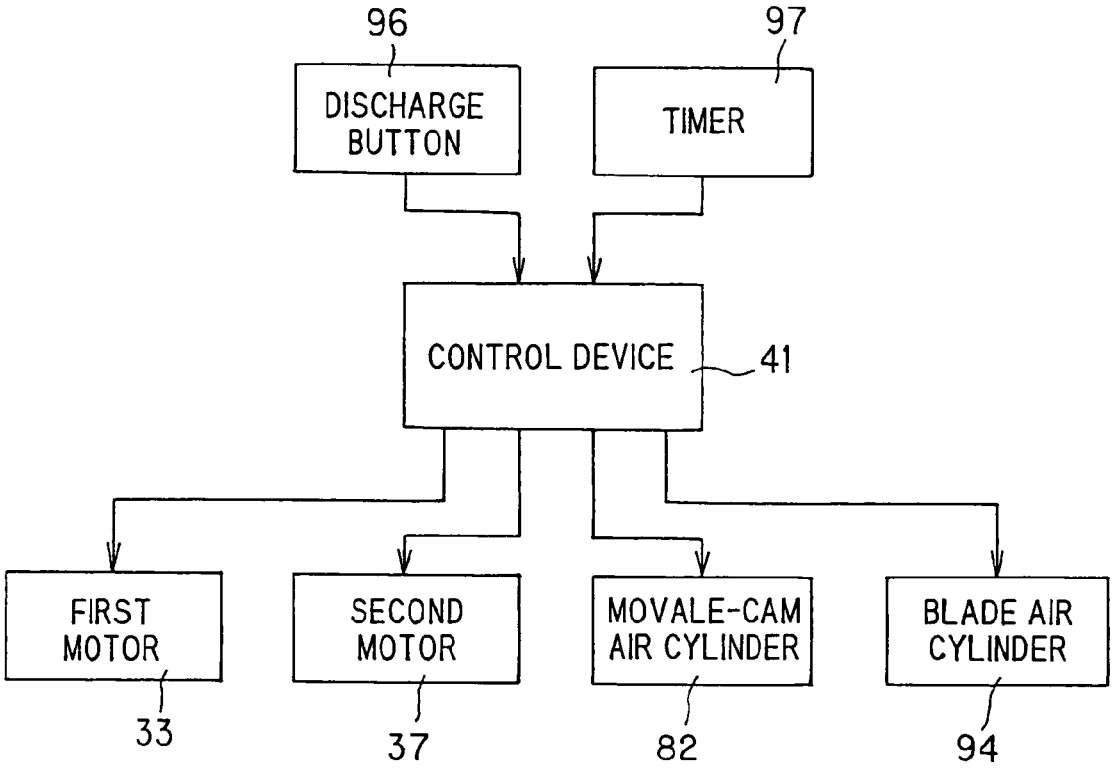
FIG. 6 shows a block diagram of a delivery control.

FIG. 6 schematically shows control blocks of the operation to collect the printing product in the case where the operation of the printing press 1 is resumed after the sudden stop caused by the power failure and the others. A discharge button 96 is provided on an operation panel (not shown) of the printing press 1. By pressing the discharge button 96, the first motor 33 and the second motor 37 are driven through the control device 41, and the movable-cam air cylinder 82 and the blade air cylinder 94 are operated therethrough.

The movable-cam air cylinder 82 is operated, and thus the gripper-opening cam 81 moves from the standby position shown by the solid line in FIG. 4 to the forward position shown by the two-dotted chain line therein. Moreover, by the operation of the blade air cylinder 94, the guide blades 91 move from the standby position shown by the solid line in FIG. 4 to the guide position shown by the two-dotted chain line therein.

By the drive of the first motor 33, the respective printing units 10*a* to 10*d* of the printing unit 3 are driven, and the sheet 7 which remains in the printing unit 3 is transported. In the transfer cylinder 14*d*, the sheet 7 is grasped by the grippers 64 of the gripper mechanisms 61 and the gripper receiver 65, and is transported following the rotation of the transfer cylinder 14*d*. However, when the wheel 85 is engaged with the gripper-opening cam 81, the grippers 64 open with respect to the gripper receiver 65. Specifically, the sheet 7 is released from the grasped state thereof, drops downward, and enters the receiving tray 95 located therebelow.

The grippers 64 open as described above, and thus the sheet 7 drops downward and is collected. However, it is possible that the sheet 7 is not separated from the transfer cylinder 14*d* owing to static electricity though the grippers 64 open. However, since the guide blades 91 enter the notched portions 71 of the transfer cylinder 14*d*, the sheet 7 is forcibly peeled off from the transfer cylinder 14*d* by the guide blades 91. Hence, the sheet 7 in the printing unit 3 is surely collected, and does not jam between the transfer cylinder 14*d* and the transport cylinder 15.

Note that the control device 41 includes a timer 97, where a fixed time is counted when the discharge button 96 is pressed. After an elapse of the fixed time, the movable-cam air cylinder 82 and the blade air cylinder 94 operate in the reverse direction, and the gripper-opening cam 81 and the guide blades 91 return to the standby positions. By this time, the collection of the sheet 7 which has remained in the printing unit 3 is ended.

By drive of the second motor 37, the sheet 7 which has remained in the machining unit 4 is transported by the transport cylinders 15 and 16, and further, is subjected to the punching process by the rotary die 18. Then, the punched portion of the printing product is discharged from the unit of the rotary die 18, and is collected. Meanwhile, the processed sheet 7*a* as a remaining portion is discharged by the delivery unit 5, and is taken on the pile board 21.

Embodiment 2

Figure 7:
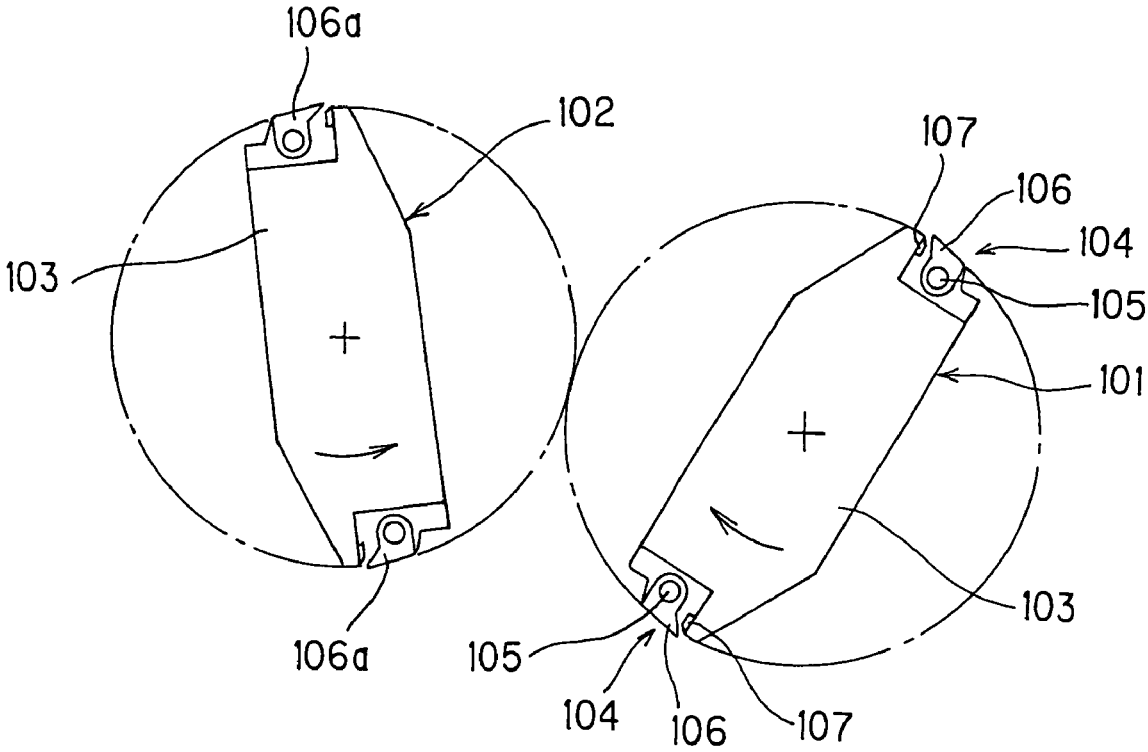
FIG. 7 shows a schematic side view of skeleton-type cylinders in another embodiment.

Embodiment 1 is an example of using cylinder-like objects as the transfer cylinder and the transport cylinder which are located in the boundary portion between the printing unit 3 and the machining unit 4. However, as shown in FIG. 7, so-called skeleton cylinders 101 and 102 can also be used as the transfer cylinder and the transport cylinder. The skeleton cylinder 101 of the printing unit 3 has a configuration in which gripper mechanisms 104 are individually provided on both ends of side plates 103 provided on both ends of a rotary shaft. Each of the gripper mechanisms 104 is composed of a plurality of grippers 106 arranged in an axial direction of a gripper shaft 105 bridged between the side plates 103, gripper receivers 107 provided on the side plates 103, and the like.

The skeleton cylinder 102 of the machining unit 4 also has a similar configuration to the above. However, grippers 106*a* are provided while deviating positions thereof from those of the grippers 106 of the skeleton cylinder 101 of the printing unit in the axial direction. Hence, even if phases of the cylinder rotations are deviated between the printing unit 3 and the machining unit 4, the grippers 106 and 106*a* do not interfere with each other.

Since the skeleton cylinders 101 and 102 do not have cylinder portions, the grippers 106 and 106*a* do not interfere with the cylinders even if the phases of the rotations of the skeleton cylinders 101 and 102 are deviated from each other. Note that the skeleton cylinders are applied, for example, for transferring a sheet with tension.

Embodiment 3

Figure 8:
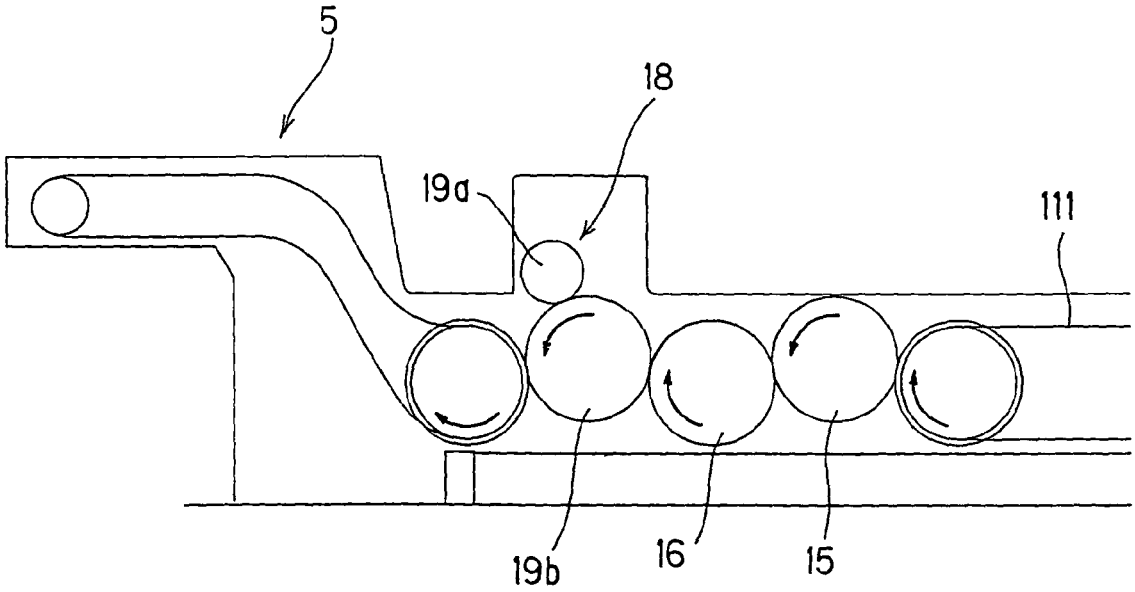
FIG. 8 shows a partial side view in still another embodiment.

An embodiment shown in FIG. 8 is one which uses a transport chain 111 in place of the cylinder-like transfer cylinder 14*d* in Embodiment 1. Specifically, in this embodiment, the sheet is transferred between the transport chain 111 provided on the final portion of the printing unit 3 and the transport cylinder 15 provided on the top-end portion of the machining unit 4. Also in this embodiment, grippers provided on the chain 111 and grippers provided on the transport cylinder 15 are provided while deviating positions thereof in the axial direction. Moreover, on the chain 111 and the transport cylinder 15, notched portions and the like, which correspond to the notched portions 71 and 72 for avoiding the interference in Embodiment 1, are provided. Other configurations are similar to those of Embodiment 1.

As combinations of the transfer mechanisms in the boundary portion between the printing unit 3 and the machining unit 4, besides those in Examples 1 to 3 described above, appropriate combinations of the cylinder-like transfer cylinder, the skeleton-like transfer cylinder, and the transport chain are conceivable.

Moreover, combinations of the cylinders are not limited to those in the above-described examples. In the cylinders in Embodiment 1, the transport cylinder 15 is made as a suction cylinder, and the transport cylinder 16 is made as a convertible cylinder, thus making it possible to convert the front and back of the transported printing product. For example, in the case where the creaser is provided in the machining unit, it is made possible to reverse a direction of a crease.

The printer in the printing unit is not limited to the offset press, and a letterpress, a lithographic press, an intaglio press a stencil press, and the like are applicable thereto. Moreover, the processor in the machining unit is not limited to the puncher, and the creaser which creases the printing product, an emboss processor which performs an emboss process for the printing product, and the like are applicable thereto.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing press, comprising:

a printing unit which performs printing on a sheet;

a machining unit which performs a machining process for the sheet;

first driving means for driving the printing unit;

second driving means for driving the machining unit;

controlling means for controlling the first and second driving means to synchronize the drives of the printing unit and the machining unit with each other;

a first cylinder driven by the first driving means and having a plurality of first recesses, each first recess accommodating, therein, first sheet holding means for holding the sheet; and a second cylinder driven by the second driving means and having a plurality of second recesses, each second recess accommodating, therein, second sheet holding means for receiving the sheet from the first sheet holding means of the first cylinder and for holding the sheet, wherein the controlling means control phases and speeds of the first cylinder and the second cylinder, such that the sheet is transferred from the first sheet holding means to the second sheet holding means, wherein, the first cylinder supports a plurality of first sheet holding means provided in the printing unit in a direction perpendicular to a transporting direction of the sheet, and has a plurality of first notched portions provided on a first circumferential surface of thereof, to which the second sheet holding means oppose, the first circumferential surface supporting the sheet; and a plurality of second sheet holding means are provided in the machining unit while deviating phases thereof from phases of the first sheet holding means in the direction perpendicular to the transporting direction of the sheet, and has a plurality of second notched portions provided on a second circumferential surface thereof, to which the first sheet holding means oppose, the second circumferential surface supporting the sheet, wherein the plurality of first recesses extends along an axial direction of the first cylinder and the plurality of first notched portions extends along a circumferential direction of the first cylinder perpendicular to the axial direction of the first cylinder, such that the plurality of first notched portions and portions of the first circumferential surface are provided alternately with respect to the axial direction of the first cylinder, and the plurality of first notched portions, in conjunction with the plurality of first recesses, forms a plurality of grooves, each groove extending along an entire circumference of the first cylinder, and the plurality of second recesses extends along an axial direction of the second cylinder and the plurality of second notched portions extends in a circumferential direction of the second cylinder perpendicular to the axial direction of the second cylinder, such that the plurality of second notched portions and portions of the second circumferential surface are provided alternately with respect to the axial direction of the second cylinder, and the plurality of second notched portions, in conjunction with the plurality of second recesses, forms a plurality of grooves, each groove extending along an entire circumference of the second cylinder.

2. The printing press according to claim 1, further comprising:

a chain which is driven and circulated, thereby transporting the sheet, wherein the chain supports at least one of the first sheet holding means and the second sheet holding means.

3. The printing press according to claim 1, wherein the controlling means controls one of the first and second driving means while taking a speed of the other one of the first and second driving means as a reference.

4. The printing press according to claim 1, wherein the machining unit performs the machining process for the sheet subjected to the printing by the printing unit.

5. The printing press according to claim 4, wherein the machining unit is a puncher.

6. The printing press according to claim 5, wherein the printing unit is an offset press.

7. The printing press according to claim 1, further comprising:

virtual speed setting means for setting a reference rotation speed, wherein the controlling means controls the first and second driving means based on the reference rotation speed set in virtual speed setting means.

8. A printing press, comprising:

a printing unit which performs printing on a sheet;

a machining unit which performs a machining process for the sheet;

first driving means for driving the printing unit;

second driving means for driving the machining unit;

controlling means for controlling the first and second driving means to synchronize the drives of the printing unit and the machining unit with each other;

a first cylinder driven by the first driving means and having first sheet holding means for holding the sheet;

a second cylinder driven by the second driving means and having second sheet holding means for receiving the sheet from the first sheet holding means of the first cylinder and for holding the sheet, and sheet releasing means for releasing retention of the sheet by the first sheet holding means on an upstream side, in the transporting direction of the sheet, of a position where the sheet is transferred between the first sheet holding means and the second sheet holding means to prevent the second sheet holding means from receiving the sheet from the first sheet holding means, wherein the controlling means control phases and speeds of the first cylinder and the second cylinder, such that the sheet is transferred from the first sheet holding means to the second sheet holding means; and wherein a plurality of first sheet holding means are provided in the printing unit in a direction perpendicular to a transporting direction of the sheet; and a plurality of second sheet holding means are provided in the machining unit while deviating phases thereof from phases of the first sheet holding means in the direction perpendicular to the transporting direction of the sheet.

9. The printing press according to claim 8, wherein, the first cylinder has a plurality of notched portions on a circumferential surface thereof, to which the second sheet holding means oppose, the circumferential surface supporting the sheet, the printing press, further comprising:

sheet dropping means for dropping the sheet of which retention is released by the sheet releasing means, the sheet dropping means entering at least one of the plurality of notched portions; and sheet collecting means for receiving the sheet dropped by the sheet dropping means.

10. The printing press according to claim 8, further comprising:

a switch to be operated after a sudden stop of the printing press, wherein the first driving means, the second driving means, and the sheet releasing means are operated by the operation of the switch through the controlling means.

11. The printing press according to claim 10, wherein the sheet releasing means is controlled to automatically return to a position thereof before the operation of the switch at predetermined timing after the sheet is discharged into the printing unit.

12. The printing press according to claim 11, further comprising:

a timer which counts a predetermined time, wherein the predetermined timing is determined by the timer.

* * * * *